US006186861B1

(12) United States Patent
Flaherty

(10) Patent No.: US 6,186,861 B1
(45) Date of Patent: Feb. 13, 2001

(54) BRA WITH STRAPS FOR MATCHING CLOTHING

(76) Inventor: Michelle Flaherty, 5800 Arlington Ave., #1G, Riverdale, NY (US) 10471

( * ) Notice: Under 35 U.S.C. 154(b), the term of this patent shall be extended for 0 days.

(21) Appl. No.: 09/498,688

(22) Filed: Feb. 7, 2000

(51) Int. Cl.[7] ..... A41C 3/00

(52) U.S. Cl. ..... 450/1; 450/88; 450/86

(58) Field of Search ..... 450/1, 86, 88, 450/7.23, 30, 31, 32, 33, 58, 64, 63, 82, 83, 84, 85; 2/78.1, 105, 106, 113–115, 80, 83

(56) References Cited

U.S. PATENT DOCUMENTS

| | | | | |
|---|---|---|---|---|
| 2,529,774 | * | 11/1950 | Iandau | 450/88 |
| 2,849,723 | * | 9/1958 | Marino | 450/88 |
| 3,311,112 | * | 3/1967 | Murray | 450/88 |
| 4,528,699 | | 7/1985 | Hughes | 2/104 |
| 4,686,715 | | 8/1987 | Price | 2/114 |
| 4,909,771 | | 3/1990 | Bergman | 450/3 |
| 4,957,466 | | 9/1990 | Hopps | 450/85 |
| 5,211,598 | | 5/1993 | Hall | 450/1 |
| 5,416,928 | | 5/1995 | Koenig | 2/244 |
| 5,842,230 | | 12/1998 | Laudick | 2/69 |

FOREIGN PATENT DOCUMENTS

| | | | |
|---|---|---|---|
| 442 186 | 1/1968 | (FR) | A41C/3/08 |
| WO 98/26683 | 6/1998 | (WO) . | |

* cited by examiner

*Primary Examiner*—Gloria M. Hale
(74) *Attorney, Agent, or Firm*—Wolff & Samson

(57) ABSTRACT

The present invention provides a bra that can be worn under a tank top, tube top, tank dress, tube dress, halter top or any other article of minimal, revealing or skimpy clothing, which would normally expose bra straps. The bra has straps that resemble an article of clothing or match an article of clothing. In one aspect of the invention, a bra has straps that look like an article of clothing. The straps can be formed of a uniform material composition along the entire length, i.e. no portion made entirely of elastic. The straps could be wider or thinner than a normal bra strap. In another aspect of the invention, a bra has straps that match an article of clothing, i.e. have the same color or a color that plays off of the color of an article of clothing, and/or contains a design that is identical to or plays off of the color or design of an article of clothing. Also, the straps may look like an article of clothing as opposed to a conventional bra strap. In another aspect of the invention, a bra is sold as a unit with an article of clothing, and the straps of the bra match the article of clothing. Again, the bra strap may look like an article of clothing as opposed to a conventional bra strap. In another aspect of the invention, a bra is provided with detachable bra straps. Two or more sets of bra straps may be provided which bra straps can be interchanged to match an article of clothing. Articles of clothing can be sold with matching straps, which can be interconnected with the body of the bra so the straps match the article of clothing.

18 Claims, 3 Drawing Sheets

BRA WITH STRAPS FOR MATCHING CLOTHING

BACKGROUND OF THE INVENTION

1. Field of the Invention

The present invention relates to a bra having straps that look like clothing and/or match clothing. Additionally, the present invention relates to a bra with interchangeable straps, and more particularly to a bra having a plurality of straps that can be interchanged so that the straps match clothing with which the bra is worn.

2. Related Art

In the present day, clothing is a highly important vehicle for use in expressing oneself, in fitting in with various social groups, and for conveying desired images of oneself to others. Also, it is very fashionable to wear relatively skimpy clothing, i.e., minimal or revealing clothing that exposes the shoulders and arms of a wearer and has thin straps or no straps. Indeed, it has been commented that skin is the most important article of clothing and accordingly, what becomes important, is not the clothing, but how much skin the clothing exposes.

With clothing such as tank tops or tube tops, which have become increasingly stylish as part of a retro movement where people are re-adopting styles from the 1970's, a lot of skin is shown. While these styles typically do not present a problem for women with small or average size breasts, who can wear a top without the need for the support that is provided by a bra, it becomes very problematic for women having larger breasts. Often times, such women have no choice but to wear bras underneath the clothing, which is generally unattractive in that it exposes the bra straps, which detracts from the look that the person is trying to achieve. Even women with smaller breasts may prefer to wear a bra under outerwear.

If, however, the bra straps were made to look like an article of clothing, and/or to match an article of clothing, the look would be much more attractive and would allow women having relatively large breasts to wear the skimpier clothing because the bra would look like an article of clothing and not like a bra. For example, a woman wearing a bra underneath a tank top might appear to be wearing two tank tops as opposed to a bra and a tank top, and it is believed that such a look would be desirable. However, heretofore no one has provided a bra with straps that look like clothing, and/or a bra with straps that match outer clothing.

Efforts in this area include the following:

Hall, U.S. Pat. No. 5,211,598, discloses an exercise brassiere having an outer layer adapted to fit over the wearer's upper torso and shoulders. The inner layer and the outer layer are constructed of lightweight, stretchable fabrics. The inner layer has cut-outs for receiving the breasts of the wearer. A middle layer may be provided for extra comfort. A covering layer may be included to cover the outer layer. The covering layer may be constructed of a decorative fabric, suitable to the taste of the wearer, so that the exercise brassiere can be worn alone as a top. A decorative fabric ruffle may be attached along the seam extending about the neck opening.

Hughes, U.S. Pat. No. 4,528,699, discloses an article of clothing for a breast feeding woman. The article of clothing includes an upper member having a loose lower edge and a lower member having an upper edge of a resilient material that can be positioned upward to cover the breasts or can be pulled down to make one of the breasts accessible to a baby. The upper and lower members may be attached together or may be separate pieces to allow a single lower member to be worn with a variety of interchangeable upper members of different styles, and vice versa. The upper member includes straps that extend about a shoulder which may take any form such as straps across the shoulders in a sundress or to the back of the neck in a halter or any other style.

Koenig, U.S. Pat. No. 5,416,928, discloses a garment attachment that can be attached to clothing. The garment attachment is a decorative, flexible panel that can be attached to clothing. The device is attached to clothing by plurality of snap fasteners.

Bergman, U.S. Pat. No. 4,909,771, discloses a brassiere made of a stretchable fabric that does not include seams, darts, moldings or shaping, but rather stretches around and generally conforms to the wearer's breasts to hold them against the body. The bra does not include clips or buckles, but does include a wide midriff portion in the front, sides and back for improved support. This patent points out that conventional bras worn under sleeveless leotards and sleeveless sports tops, such as tennis or running tops, tend to expose the bra strap, and this visibility of the bra is aesthetically undesirable. The whole of the bra, including the shoulder straps, are made of the same fabric. The bra includes shoulder straps spaced widely apart that can be readily worn under sleeveless leotards and sleeveless sports tops such as tennis running tops which are normally fairly low or wide cut around the neck, without the straps being visible. Also, the bra can be worn as outerwear.

Laudick, U.S. Pat. No. 5,842,230, discloses a halter top made from a portion of a pair of pants. The connecting straps are formed from material removed from the pants and attached in a configuration such that the former back pockets from the pants make up the cups of the halter top or bra and cover the wearer's breasts. The shoulder and side straps are trimmed to a desired length from the seam of the pants.

Hopps, U.S. Pat. No. 4,957,466, discloses a support garment having a multi-layered rectangular front panel and a back panel and two adjustable shoulder straps interconnecting the front panel and the back panel and extending about a wearer's shoulder. The supporting garment can be worn in place of a bra, or over existing clothing or even as an outer garment. The straps are of a wide design to help disburse strain. The straps may be adjustable. The straps are fixed to the back panel and are provided with hook and loop fasteners to interconnect with matching hook and loop fasteners located on the interior surface of the front panel.

Price, U.S. Pat. No. 4,686,715, discloses a patient gown having front and back panels which are identical so that the gown segments are interchangeable from the left side to the right or front to back to alleviate sorting problems in supply rooms.

Gionfriddo, International Patent WO 98/26683, discloses a bra provided with attaching or fastening elements on the shoulder straps which can be used to interconnect shoulder pads having matching fastening elements.

Laage, International Patent CH 442,186, discloses a bra with matching dress and/or matching underwear.

It is also known to provide strapless bras, i.e. bras with a body portion but no straps, as well as tank tops with adjustable straps. Additionally, it is known to provide tank tops with removable straps so that the tank top can be converted to a tube top. Also, it is known to provide a bra with straps which are detachable from the bra body at the back end, and attachable together to form a "halter" style bra. It is submitted, however, that none of these works of others disclose all of the elements of the present invention, nor do they disclose all of the benefits of the present invention.

OBJECTS AND SUMMARY OF THE INVENTION

It is a primary object of the present invention to provide a bra with straps, which bra and straps look like an article of outerwear clothing.

It is an additional object of the present invention to provide a bra with straps, which straps look like an article of outerwear clothing.

It is another object of the present invention to provide a bra with straps, which when worn under clothing, looks like a first article of outerwear clothing worn under a second article of outerwear clothing.

It is still a further object of the present invention to provide a bra with straps which matches an article of outerwear clothing worn thereover.

It is an additional object of the present invention to provide a bra with straps wherein the straps match an article of outerwear clothing worn thereover.

It is an additional object of the present invention to provide a bra that can be worn underneath a tank or tube top and which looks like an article of clothing rather than a bra.

It is a further object of the present invention to provide a bra with straps that are made of the same material along the length thereof and do not have a visible elastic portion along the length thereof.

It is even a further object of the present invention to provide a bra with straps which straps are attachable and detachable from the bra.

It is even a further object of the present invention to provide a bra and a plurality of straps, which are attachable and detachable to a bra, and which can be matched with an article of clothing.

It is an additional object of the present invention to provide a bra and a plurality of straps wherein straps can be interconnected with the bra by any known attachment means.

It is even an additional object to provide a bra that can be worn under any clothing including skimpy clothing.

The present invention provides a bra that can be worn under a tank top, tube top, tank dress, tube dress, halter top or any other article of minimal, revealing or skimpy clothing, which would normally expose bra straps. The bra has straps that resemble an article of clothing or match an article of clothing. In one aspect of the invention, a bra has straps that look like an article of clothing. The straps can be formed of a uniform material composition along the entire length, i.e. no portion made entirely of elastic. The straps could be wider or thinner than a normal bra strap. In another aspect of the invention, a bra has straps that match an article of clothing, i.e. have the same color or a color that plays off of the color of an article of clothing, and/or contains a design that is identical to or plays off of the color or design of an article of clothing. Also, the straps may look like an article of clothing as opposed to a conventional bra strap. In another aspect of the invention, a bra is sold as a unit with an article of clothing, and the straps of the bra match the article of clothing. Again, the bra strap may look like an article of clothing as opposed to a conventional bra strap. In another aspect of the invention, a bra is provided with detachable bra straps. Two or more sets of bra straps may be provided which bra straps can be interchanged to match an article of clothing. Articles of clothing can be sold with matching straps, which can be interconnected with the body of the bra so the straps match the article of clothing.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a highly functional bra which can be worn in connection with outerwear (shirts, tops, blouses, dresses, etc.). The bra does not resemble a conventional bra. Rather, the bra is preferably made with bra straps that resemble clothing. If the straps are exposed, they appear to be an article of clothing rather than an undergarment. As such, the bra straps can be made of a material that resembles an article of outerwear and can be of a color or design such that it resembles outerwear. Additionally, the bra straps can be designed to have a pattern that matches, is identical to, is complimentary to, or coordinates with an article of outer clothing. Indeed, the bra can be sold together with an article of outerwear as a package. In another embodiment of the present invention, a bra is provided with detachable straps and any desired straps with appropriate attachment means can be interconnected therewith such that one bra can be worn with different straps to match or compliment different articles of outerwear. In this case, a bra can be sold with a plurality of straps having different colors or having different designs thereon, and straps can be sold alone, or with articles of outerwear, to allow one to form a complete ensemble.

Figure 1:
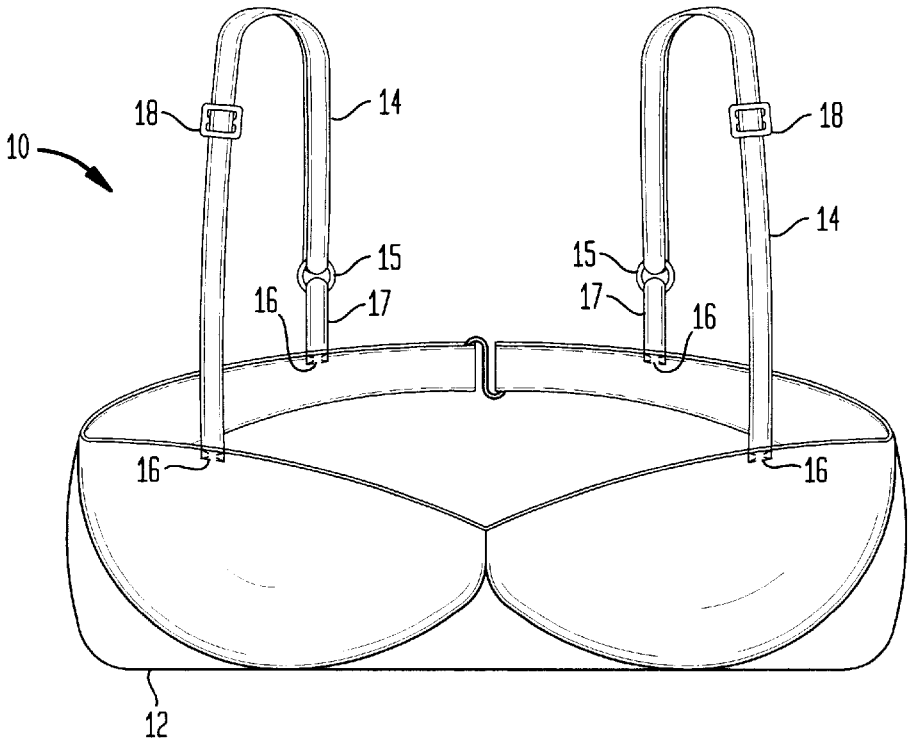
FIG. 1 (PRIOR ART)
FIG. 1 is a conventional bra with conventional straps.

Referring to FIG. 1, a bra according to the prior art is shown. The bra, generally indicated at 10, includes a body portion 12 and straps 14. The straps 14 are interconnected with the bra 10 at seams 16 typically by being sewn or stitched thereto. The bra 10 typically includes strap adjustment, which has been indicated as 18. Conventionally, the bra straps 14 are formed of an elastic material 17 that extends at least partially along the length of the strap 14, the remaining portion of the strap 14 being a blend of a natural or synthetic material and elastic. The elastic portion 17 is interconnected at one end with the bra body 12 and the other end with the remaining portion of the strap by means of clip, loop or other attachment means 15. It is desirable that the straps are visually unobtrusive when worn under outerwear. However, a problem with the bras of prior art occurs when an individual wears a skimpy outer garment which may include thin straps in the form of a tank top, or straps known as spaghetti straps, or when worn with a tube top that has no straps. Women having smaller breasts can wear such outerwear without the need for wearing a bra thereunder, but women having larger breasts require the support of a bra.

Also, many women, even those with smaller breasts, may feel uncomfortable wearing a shirt without a bra thereunder. However, when skimpy outerwear is worn, the bra straps can be seen and may look unattractive. The present invention addresses this problem in a number of ways.

Figure 2:
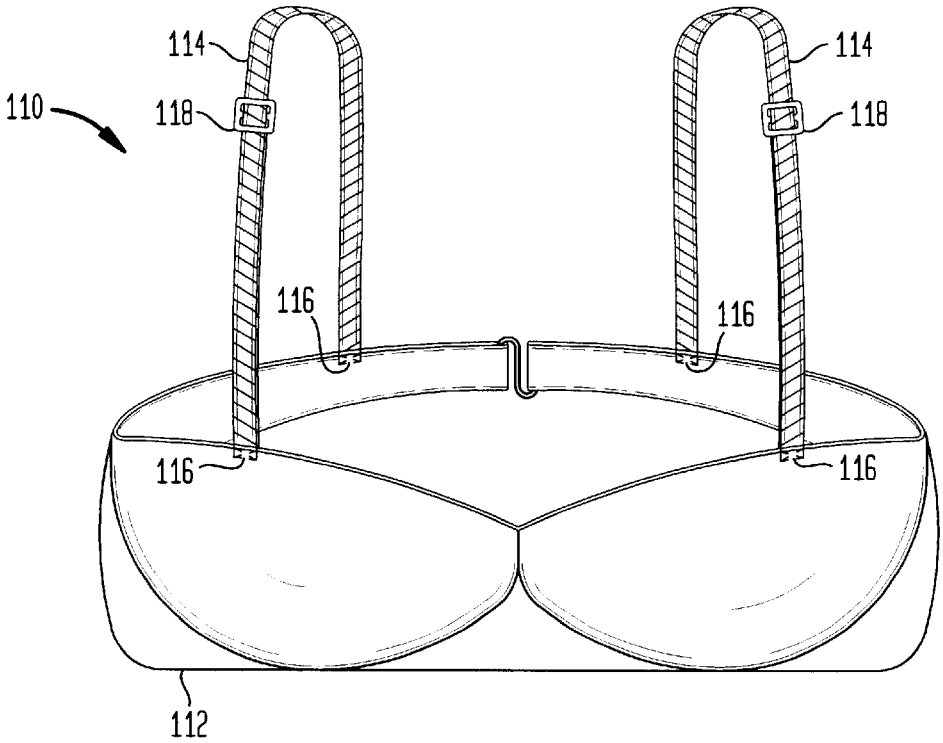
FIG. 2 is a perspective view of a bra accordingly to the present invention wherein the straps look like an article of clothing.

Referring to FIG. 2, a bra 110 is shown according to the present invention. This bra 110 also includes a bra body 112 and straps 114. The straps 114 are interconnected with the bra body 112 by means of stitching 116, or any other means known in the art. As can be seen by comparing the straps 114 shown in FIG. 2 with the straps 14 shown in FIG. 1, the straps 114 are designed to appear like straps associated with outerwear, as opposed to bra straps. As such, straps 114 could be made wider than conventional straps. Alternatively, the straps 114 could be the same size or even smaller than conventional bra straps. The straps may be adjustable by means of strap adjustments 118.

Further, straps 114 could be formed such that they are not entirely elastic along a portion of the strap 114, but rather are formed of a uniform material or fabric along the entire length, i.e. the entire strap is made of the same material. Accordingly, any desired fabric or blend of fabric, or even different fabrics for different portions, can be used for the straps 114, but preferably, no portion of the strap 114 is formed entirely of an elastic material. Rather, preferably, the material used is a material conventionally associated with outerwear. Using such a material, rather than using elastic for the portion of the length of the straps 114 allows the straps 114 to resemble an article of outerwear. Likewise, the straps 114 can have a design thereon which can match outerwear, or could be of a color that matches or compliments outerwear in connection with which it is worn. Importantly, the affect of the straps 114 is that when they are worn under a skimpy outerwear, and can be seen, the straps resemble clothing as opposed to a bra strap.

Figure 3:
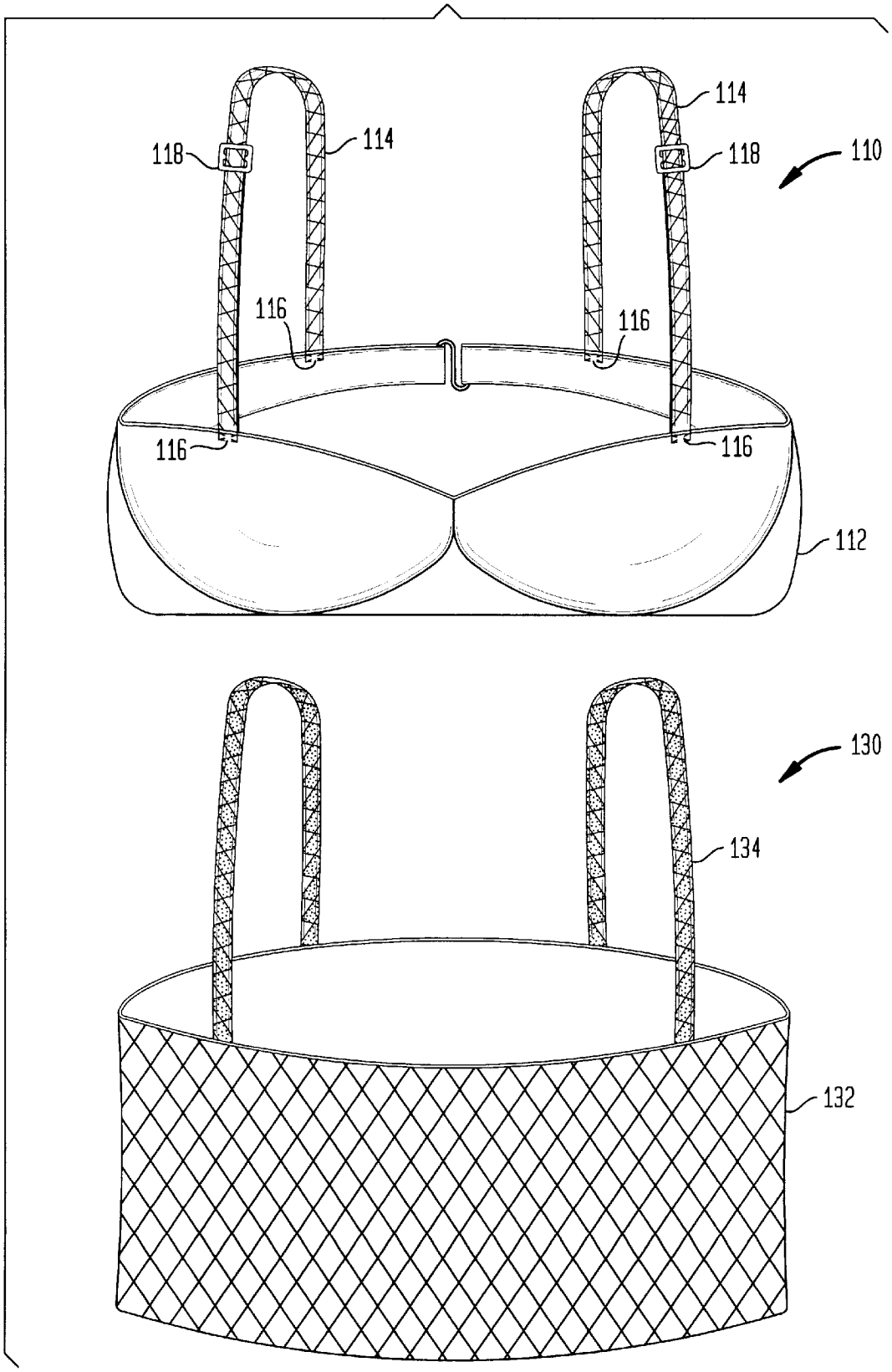
FIG. 3 is a perspective view of a bra with straps of the present invention which match an article of clothing.

As shown in FIG. 3, the bra 110 with straps 114 shown in FIG. 2 could be worn with an outer garment generally indicated at 130 having a body 132 and straps 134. As can be seen, the outer garment 130 is relatively skimpy and the straps 134 can move around when a person wears it such that, if worn with a conventional bra, the straps would likely show and therefore, the overall appearance may be unattractive. However, with the bra 110 of the present invention, the straps 114 appear to be outer garment type straps and when the bra 110 is worn with the outerwear 130, and the outerwear straps 134 move about and expose the bra straps 114, it still presents a very attractive look. Indeed, bra 110 can be packaged together and sold as a unit with outerwear 130 such that when one buys an article of outerwear, one can have a bra with matching straps 114 therefore.

Figure 4:
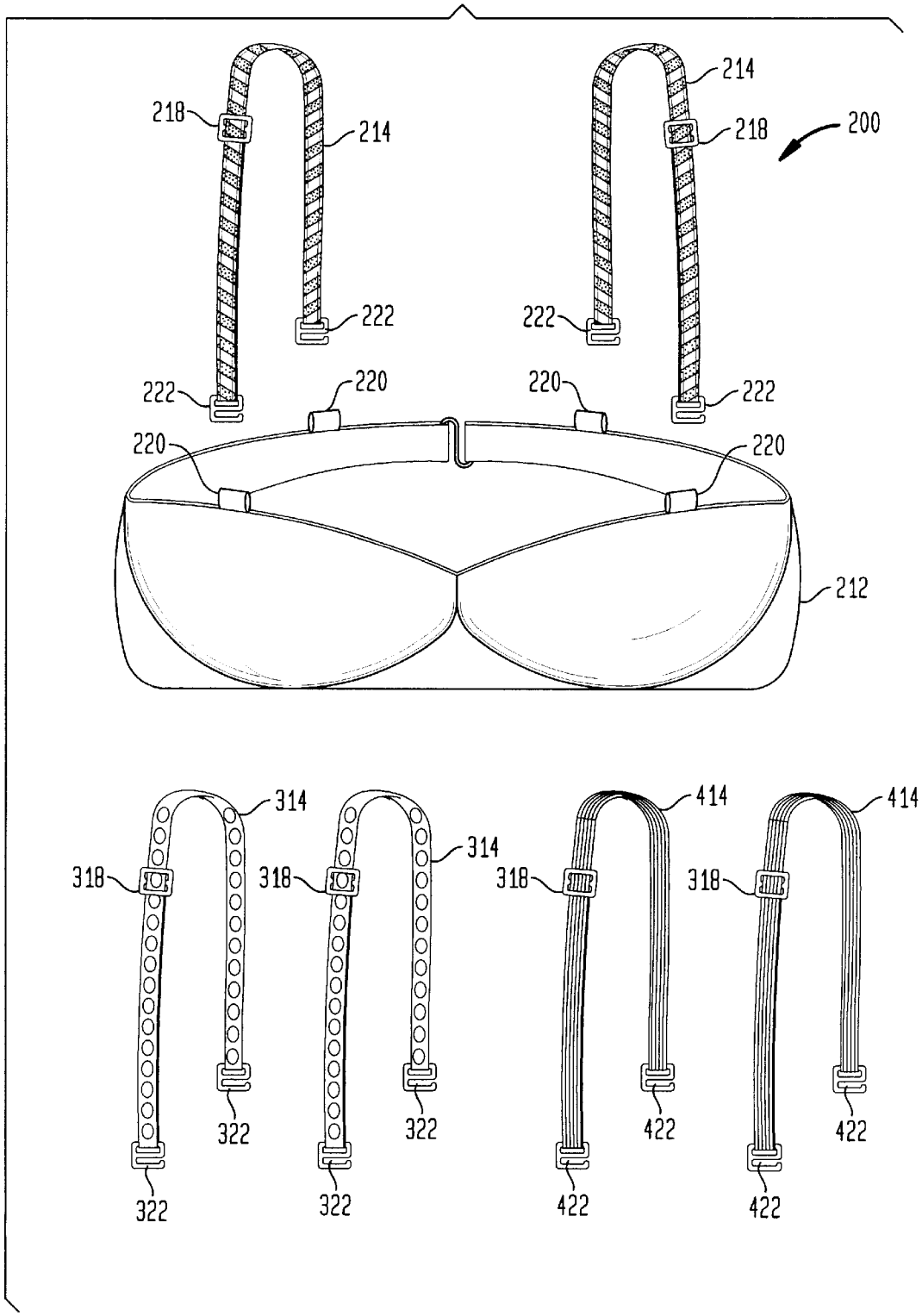
FIG. 4 is a perspective view of a bra with detachable straps according to the present invention. showing a plurality of straps for matching different articles of clothing.

FIG. 4 shows another embodiment of the present invention. A bra generally indicated at 200 includes a body portion 212 and straps 214. In this embodiment, the body 212 has attachment means which coacts with attachment means formed on the straps 214 to detachably attach the straps 214 to the body 212. In the embodiment shown in FIG. 4, a material loop 220 is formed on the body 212 and a hook 222 is attached to the lower ends of the straps 214 such that the hooks 222 coact with the loops 220 to attach the strap 214 to the body 212. As can be understood, any known attachment means can be used to interconnect the straps with the bra, including, but not limited to, buttons, hook and pile fastener assemblies, any sort of hook and loop system or any other attachment system known in the art. Importantly, in this embodiment of the invention, the straps 214 can be attached and detached to the body 212 such that any desired straps, of a plurality of straps, can be utilized with the body of the bra. For example, straps 314 or 414 each of which contain fastening means 322 and 422 respectively, can be substituted for straps 214 to provide a bra with straps of a desired design or color for matching or complimenting an outer garment.

T he bra with attached detachable straps can be sold with a single body portion 212 and a plurality of different colors or straps 214, 314, 414 having different designs thereon. Alternatively, the bra body 212 can be sold individually and straps 214, 314, 414, etc. can be sold individually such that one can buy a body and whatever straps one wishes. Alternatively, the straps 214, 314, or 414 can be specifically designed to match outer garments and can be sold as a unit with such outer garments. Any of the straps 214, 314, 414, etc. used in connection with the body 212 can be formed in accordance with the discussion set forth herein with respect to other embodiments of the invention, specifically, the straps can be designed to appear like outer clothing as opposed to bra straps.

Having thus described the invention in detail, it is to be understood that the foregoing description is not intended to limit the spirit and scope thereof. What is desired to be protected by Letters Patent is set forth in the appended claims.

What is claimed is:

1. A bra comprising:

a body portion for extending about one's body; and straps interconnected with the body portion for extending over one's shoulders;

wherein the straps comprise:

a uniform material including elastic as a component thereof extending along the length thereof; and adjustment means for adjusting the length; and the straps resemble outerwear.

2. The bra of claim 1 wherein the straps are wider than conventional bra straps.

3. The bra of claim 1 wherein the straps are thinner than conventional bra straps.

4. The bra of claim 1 wherein the straps have a design formed thereon extending along the entire length thereof.

5. The bra of claim 1 wherein the straps are of a color to match outerwear.

6. A bra sold as a unit with an article of outerwear comprising:

a bra body portion for extending about one's body;

straps interconnected with the bra body portion for extending over one's shoulders;

an article of outerwear;

a package for maintaining the bra and article of outerwear as a unit until sold;

wherein, the straps of the bra match the article of outerwear.

7. The bra sold as a unit with an article of outerwear of claim 6 wherein the straps further comprise a uniform material along the length thereof.

8. The bra sold as a unit with an article of outerwear of claim 7 wherein the straps further adjustment means for adjusting the length thereof.

9. The bra sold as a unit with an article of outerwear of claim 6 wherein the straps are wider or thinner than conventional bra straps.

10. The bra sold as a unit with an article of outerwear of claim 6 wherein the straps are thinner than conventional bra straps.

11. The bra sold as a unit with an article of outerwear of claim 6 wherein the straps comprise a material that may include elastic as a component thereof, and which material extends throughout the entire strap.

12. The bra sold as a unit with an article of outerwear of claim 6 wherein the straps have a design formed thereon extending along the entire length thereof.

13. A bra comprising:

a body portion for extending about one's body;

first attachment means provided on the body;

an article of clothing and matching first bra straps sold as a unit, the first straps for extending about one's shoulder; and second attachment means associated with the ends of the first straps;

wherein the first attachment means on the body and the second attachment means on the first straps coact to detachably attach the first straps to the body to be worn under the article of clothing.

14. The bra of claim 13 further comprising second straps having a different appearance from the first straps for attachment to the bra in place of the first straps.

15. The bra of claim 13 wherein the first and second straps resemble articles of clothing.

16. The bra of claim 13 further comprising a plurality of straps of different appearance for attachment to the body to match outerwear with which the bra is to be worn.

17. A method for matching bra straps to an article of clothing comprising;

providing an article of clothing;

providing matching bra straps;

providing a bra body; and detachably attaching the matching straps to the bra body.

18. The method of claim 17 wherein the bra can be matched to a second article of outerwear by detaching the matching straps from the bra;

providing second matching straps, the second matching straps matching the second article of outerwear; and attaching the second matching straps to the body.

* * * * *